US005766705A

United States Patent [19]

O'Brien et al.

[11] Patent Number: 5,766,705

[45] Date of Patent: Jun. 16, 1998

[54] MARKER SLEEVE ASSEMBLY

[75] Inventors: John Terence O'Brien, Pleasanton; C. Joseph Weber, Portola Valley; Francis Yankello, Fremont, all of Calif.

[73] Assignee: Raychem Corporation, Menlo Park, Calif.

[21] Appl. No.: 541,844

[22] Filed: Oct. 10, 1995

[51] Int. Cl.[6] ..... B65D 85/20; B65D 63/00

[52] U.S. Cl. ..... 428/34.9; 428/35.1; 428/43; 428/138; 428/192; 428/913; 206/345; 206/390; 206/820; 174/DIG. 8

[58] Field of Search ..... 428/34.9, 35.1, 428/43, 910, 913, 137, 138, 192; 206/820, 345; 174/DIG. 8; 40/316

[56] References Cited

U.S. PATENT DOCUMENTS

| | | | |
|---|---|---|---|
| 2,013,844 | 9/1935 | Sherman | 229/69 |
| 2,058,035 | 10/1936 | Rand | 93/1 |
| 2,201,950 | 5/1940 | Wolters et al. | 154/43 |
| 2,217,506 | 10/1940 | Bottle | 282/12 |
| 3,339,828 | 9/1967 | Hiersteiner | 229/72 |
| 4,032,010 | 6/1977 | Evans | 206/345 |
| 4,070,223 | 1/1978 | Stalzer | 156/264 |
| 4,191,405 | 3/1980 | Johnstun | 428/34.9 |
| 4,198,451 | 4/1980 | Johnstun | 428/34.9 |
| 4,239,399 | 12/1980 | Johnstun | 400/128 |
| 4,347,274 | 8/1982 | Janssen | 428/78 |
| 4,361,230 | 11/1982 | Downing et al. | 206/345 |
| 4,363,401 | 12/1982 | Savagian | 174/DIG. 8 |
| 4,425,390 | 1/1984 | Changani et al. | 174/DIG. 8 |
| 4,442,939 | 4/1984 | Downing | 206/345 |
| 4,448,558 | 5/1984 | Weingarten | 400/529 |
| 4,487,645 | 12/1984 | Weston | 156/157 |
| 4,574,440 | 3/1986 | Wirth et al. | 29/33 E |
| 4,586,610 | 5/1986 | Gandolfo | 206/485 |
| 4,636,271 | 1/1987 | Gandolfo | 174/DIG. 8 |
| 4,655,129 | 4/1987 | Wirth et al. | 101/35 |
| 4,865,895 | 9/1989 | Vlamings et al. | 428/35.1 |
| 5,110,638 | 5/1992 | Vogdes et al. | 428/35.1 |

FOREIGN PATENT DOCUMENTS

| | | |
|---|---|---|
| 0545836 | 11/1992 | European Pat. Off. . |
| 1536178 | 12/1978 | United Kingdom . |
| 2126169 | 3/1984 | United Kingdom . |

OTHER PUBLICATIONS

CTK Corporation—Tokyo, Japan "Hotmarker News" Product Brochure 1993–1994.

CTK Corporation—Tokyo, Japan Marking Machine for Tube, Label & Terminal ID Boards (Product Brochure).

*Primary Examiner*—Rena Dye

*Attorney, Agent, or Firm*—Herbert G. Burkard; Sheri M. Novack

[57] ABSTRACT

A marker sleeve assembly having a length of marker sleeves and a carrier configured such that the length of marker sleeves is oriented parallel to the carrier. The length of marker sleeves is held in a fixed, straight line adjoining the carrier, thereby reducing movement during the printing operation. Additionally, markings may be applied to both the length of marker sleeves and the carrier in a single printing operation.

18 Claims, 3 Drawing Sheets

MARKER SLEEVE ASSEMBLY

This invention relates to a marker sleeve assembly for holding recoverable marker sleeves in appropriate position for printing indicia on the marker sleeves and then providing a convenient means for dispensing the printed marker sleeves for use on wires or other objects to be identified by the printed marker sleeves.

BACKGROUND OF THE INVENTION

Heat recoverable marker sleeves have been used and dispensed in various assemblies and configurations. The marker sleeves assemblies are often insertable into a printer for marking the sleeves which are then heat recoverable onto wires, substrates or other objects and used to mark the wires, substrates, or other objects. Traditionally, marker sleeves are positioned transversely to the direction of travel through the printer on a carrier or sheet to form the marker sleeve assembly.

In some assemblies, such as described in U.S. Pat. No. 4,032,010 to Evans, the sleeves must be partially recovered onto fingers of a carrier to hold them in place while printing. After printing, the sleeves are removed from the fingers of the carrier, placed on the wire or substrate and further recovered into final position.

In other assemblies such as described in U.S. Pat. Nos. 4,361,230 to Downing et al; 4,363,401 to Savagian; and 4,425,390 to Changani et al; the marker sleeves are attached to a carrier or sheet such that they must be removed in order, beginning with only the first or last marker sleeve on the carrier or sheet.

U.S. Pat. No. 4,865,895 to Vlamings et al issued on Sep. 12, 1989, the disclosure of which incorporated by reference herein for all purposes, discloses a marker sleeve assembly comprising a series of flattened tubular recoverable marker sleeves held by at least one carrier strip which holds the sleeves in fixed spaced apart relations extending laterally from the strip. The length of the marker sleeves is constant for each of the sleeves on a particular carrier. Furthermore, with this structure, it is difficult or impossible to print on both the carrier and the marker sleeves in a single printing operation.

Some attempts have been made to print on marker sleeves in the direction of movement of tubing, such as manufactured by CTK Corporation of Japan. In these devices, the tubing is pulled through a printer specifically modified for this purpose. Modifications include the addition of a system of pulleys and rollers which keep the tubing taut while moving through the printer. Such systems mark tubing at a much slower rate than conventional printers and must be modified at considerable expense.

SUMMARY OF THE INVENTION

We have designed a marker sleeve assembly in which markings can be applied to both the marker sleeve and the carrier in a single printing operation and which allows the length of sleeves to be fed longitudinally to the printer in the same direction as the carrier, thus reducing alignment problems which can occur during the printing of transverse sleeves. The assembly of the present invention can be marked using a variety of conventional printers.

A first aspect of the invention comprises a marker sleeve assembly comprising:

a carrier having a longitudinal axis, said carrier comprising an inner edge portion and an outer edge portion;

a length of recoverable marker sleeves having a longitudinal axis parallel to the longitudinal axis of the carrier, said length of sleeves comprising a first edge portion and a second edge portion and wherein the first edge portion of the length of sleeves adjoins the inner edge portion of the carrier; and adhesive means for securing the length of sleeves and the carrier along the first edge portion of the length of sleeves and the inner edge portion of the carrier.

A second aspect of the invention comprises a marker sleeve assembly comprising:

a carrier having a longitudinal axis, said carrier comprising an inner edge portion and an outer edge portion;

a length of recoverable marker sleeves having a longitudinal axis parallel to the longitudinal axis of the carrier, said length of sleeves comprising a first edge portion and a second edge portion and wherein the first edge portion of the length of sleeves abuts the carrier;

a tape for securing the length of sleeves and the carrier along the first edge portion of the length of sleeves and the inner edge portion of the carrier, said tape overlapping said carrier and extending at least partially across said length of sleeves;

said length of sleeves comprising perforations in the length of sleeves perpendicular to the longitudinal axis of the length of sleeves so as to be separable into individual marker sleeves to form separate individual markers of varying length; and wherein said length of sleeves and carrier are configured so as to be insertable in a printer such that markings are printable on the length of sleeves and on said carrier in a direction parallel to the longitudinal axes of the carrier and the length of sleeves.

A further aspect of the invention comprises a marker sleeve assembly comprising:

DETAILED DESCRIPTION OF THE PREFERRED EMBODIMENTS

Figure 1:
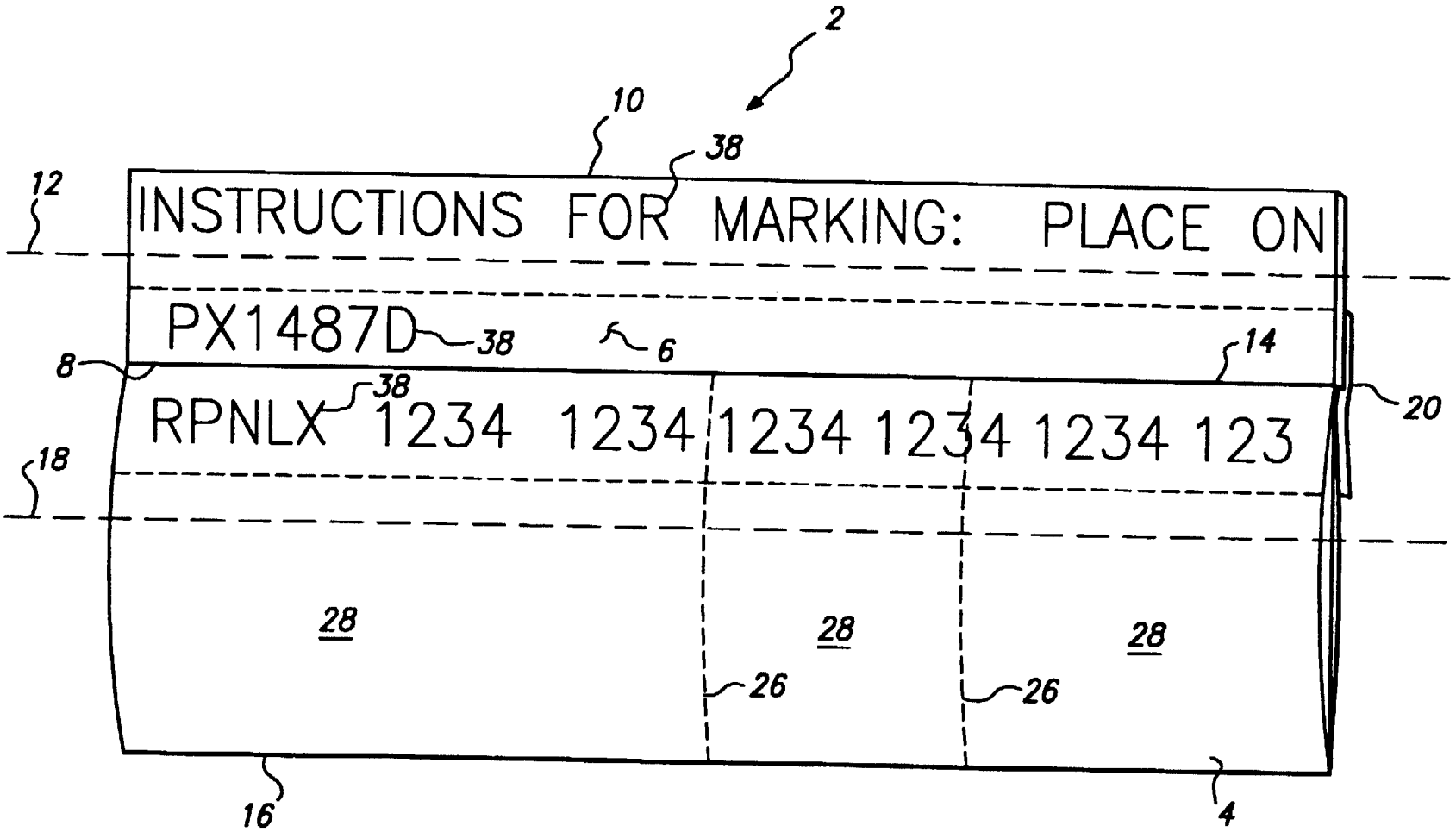
FIG. 1 is a front perspective view of the marker sleeve assembly of the present invention.

Referring now to the drawings, FIG. 1 illustrates a marker sleeve assembly 2 including a length of recoverable marker sleeves 4 longitudinally adjoining means for holding length of sleeves 4, such as a carrier 6.

Carrier 6 includes an inner edge portion 8 and an outer edge portion 10 having a longitudinal axis 12 parallel to both the inner and outer edge portions. The inner edge portion of carrier 6 is the portion of the carrier or length of marker sleeves which adjoins the length of marker sleeves. The outer edge portion of carrier 6 is the portion of the carrier away from the length of marker sleeves.

Length of recoverable marker sleeves 4 includes a first edge 14 and a second edge 16 and a longitudinal axis 18 parallel to both the first and second edge portions. First edge portion 14 of the length of marker sleeves adjoins inner edge portion 8 of the carrier. The length of sleeves must be held in a fixed, straight line with respect to the carrier. This reduces movement during the printing operation so that the sleeves do not drift during printing, which would cause the markings on the sleeve to be uneven or wander off the sleeve. The material from which the length of sleeves is constructed does not have sufficient strength to remain fixed in a straight line. In order for the carrier to hold the length of sleeves in a fixed straight line, the carrier must be have some rigidity or strength, sufficient to prevent drifting of the length of sleeves, and thereby holding the length of sleeves in a fixed straight line.

Figure 2:
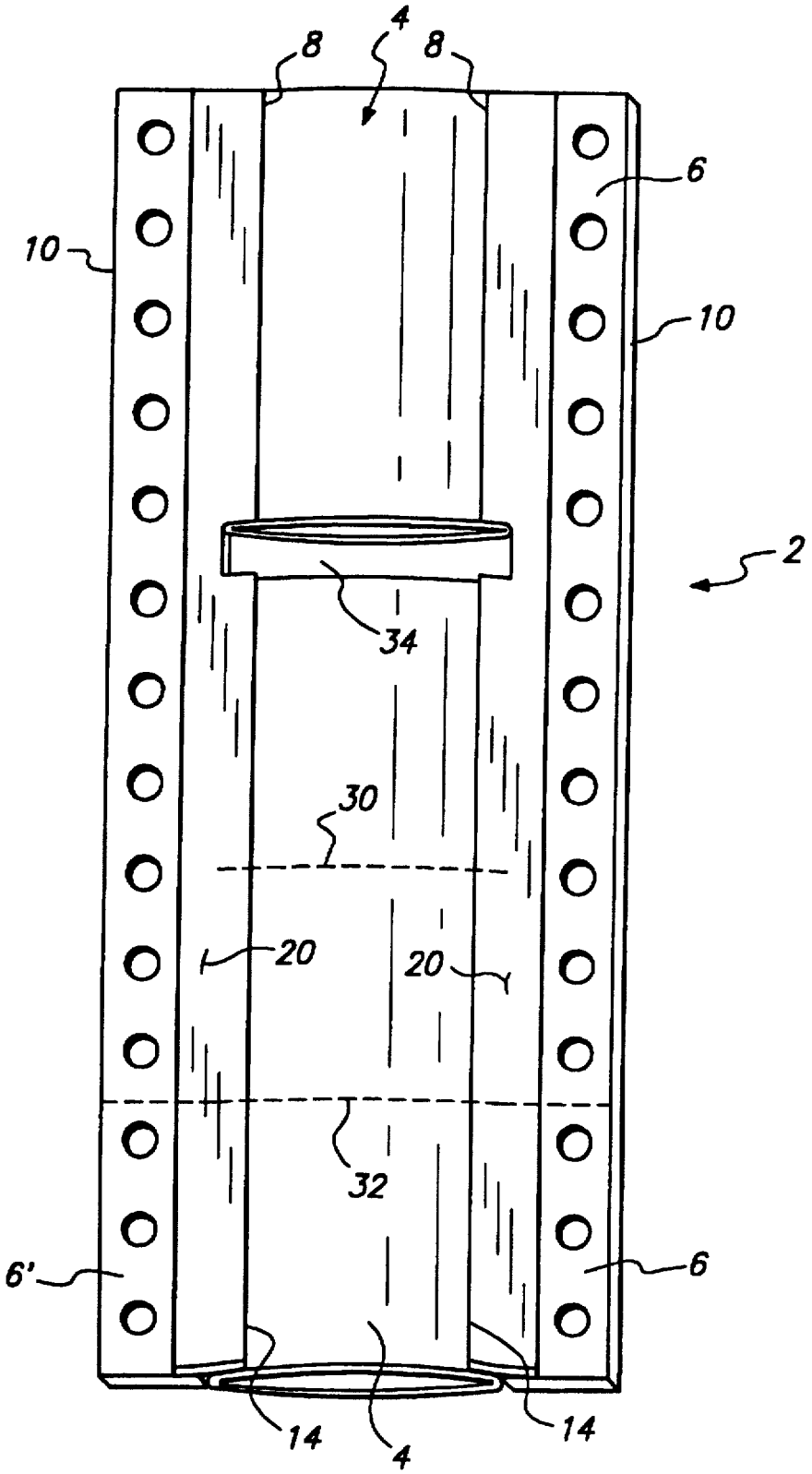
FIG. 2 is a front perspective view of an alternative embodiment of the present invention.

Length of sleeves 4 and carrier 6 are fixed to each other by securing means such as adhesive means. Adhesive means may be in the form of a tape 20, as seen in FIGS. 1 and 2 or an adhesive applied to a portion of one or both of inner edge portion 8 or first edge portion 14. The means for securing length of sleeves 4 to carrier 6 is most preferably a single layer of tape overlapping the carrier and extending at least partially across the length of sleeves, as seen in FIG. 1. However, it is within the scope of the present invention to provide two layers of tape, rather than a single layer, one layer being on each surface of the length of sleeves and carrier or to provide a tape such that it extends across the entire width of the length of sleeves.

The material forming length of sleeves 4 is similar to the flattened tubular sleeves disclosed in U.S. Pat. No. 4,865,895 described above and incorporated by reference. The outer layer of material of the carrier is constructed of a material on which markings are printable, constructed of either a single layer or multiple layers such as a laminate. The most preferred material is paper; however, any material on which markings can be made is within the scope of this invention. The thickness of the carrier is preferably substantially the same thickness as that of the length of sleeves when inserted into the printer. The thickness of the length of sleeves, at times, may contain air so that the length of sleeves is not in its completely flattened state. The thickness of the length of sleeves referred to herein is the thickness of the length of sleeves when inserted into the printer.

Figure 3A:
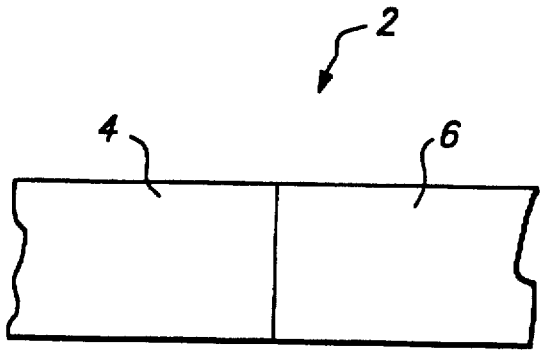
FIGS. 3*a* and 3*b* are schematic views of alternative embodiments of the interface between the length of marker sleeves and the carrier.
Figure 3B:
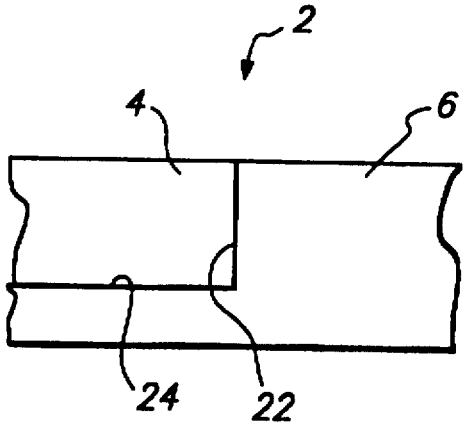

The marker sleeve assembly of the present invention is designed such that markings can be applied to both the marker sleeve and the carrier in a single printing operation. Such printing is possible because the thickness of the marker sleeve assembly is substantially uniform. This may be achieved by constructing the length of marker sleeves and the carrier of substantially the same thickness, abutting each other as seen in FIG. 3*a*. Alternatively, the marker sleeve assembly may be constructed such that the carrier extends beneath the length of sleeves, as seen in FIG. 3*b*. In the embodiment of FIG. 3*b*, carrier 6 includes a shoulder 22 and a ledge 24 extending from the shoulder. Length of sleeves 4 is retained on ledge 24, abutting shoulder 22.

Length of sleeves 4 may be continuous and cut to the desired length as needed. Alternatively, the length of sleeves may include perforations 26 formed perpendicular to longitudinal axes 12, 18 such that the length of sleeves 4 is separable into individual marker sleeves 28. The length of sleeves may or may not be separated along perforations 26, making it is possible to form separate individual sleeves of varying length. Perforations may be made only across the width of the length of sleeves as seen in FIG. 2 at perforations 30, or may be made across the entire width of marker sleeve assembly 2, as seen in FIG. 2 at perforations 32. Alternatively, individual marker sleeves 28 may be spaced apart from each other. An example of spacing is shown in FIG. 2 at cutout 34.

The present invention may be used in connection with any conventional printer type, for example, a thermal transfer or dot matrix printer.

A marker sleeve assembly configured to be marked with a dot matrix printer includes pin feed holes 36 for retaining the marker sleeve assembly aligned with the printing head. Feed holes 36 are formed in carrier 6 adjacent its outer edge 10. In this way, it is possible to mark both the length of sleeves and the carrier in a single printing operation. An embodiment having two carriers may or may not include a row of feed holes 36 in each carrier, as seen in FIG. 2.

A marker sleeve assembly configured to be marked with a thermal transfer printer need not include pin feed holes. A thermal transfer printer includes a centering device which would hold the marker sleeve assembly aligned for printing. An outer edge 10 of carrier 6 rides against one side of the centering device. In the embodiment of FIG. 1, the second edge 16 of the length of marker sleeves 4 rides against the other side of the centering device, while in the embodiment seen in FIG. 2, a second outer edge 10 of the carrier serves this purpose. It is, however, within the scope of the present invention, to employ holes, such as shown by numeral 36, in an embodiment marked by a thermal transfer printer. In such an embodiment, holes 36 serve as index holes. Index holes are useful in connection with optical sensors located in thermal transfer printers for automatically indexing the marker sleeve assembly as it travels through the printer.

In operation, marker sleeve assembly 2 is inserted into the printer for marking the length of sleeves and/or carrier in a direction parallel to the longitudinal axes of the carrier and the length of sleeves, as seen in FIG. 1 at markings 38. In other words, markings 38 may be printed on the carrier and/or length of sleeves in landscape orientation. It is noted that while markings 38 are depicted in FIG. 1 as being in alphanumeric form, any graphic representation may be printed on the marker sleeve assembly. During the print operation, because the thickness of marker sleeves assembly 2 is substantially uniform, markings may be printed on both the length of sleeves 4 and carrier 6 in a single printing operation. It is also possible to print markings on both sides of the length of sleeves and carrier.

As discussed above, the printer employed may be a dot matrix printer, for which holes 36 serve to align marker sleeve assembly 2; a thermal transfer printer having a centering device in which outer edge 10 serves to align the marker sleeve assembly, with or without an optical sensor; or any other convention printer.

After printing, length of sleeves 4 can be cut so that individual sleeves 28 are the desired length. In an alternate embodiment, length of sleeves 4 can be separated along perforations 26 to form individual sleeves 28. An individual sleeve 28 is placed on a wire, substrate or other object and heat recovered to be identified by the marker sleeve.

The width of length of sleeves 4 provided along a carrier may vary. Additionally, marker sleeve assembly 2 may include a second length or multiple lengths of sleeves positioned parallel and adjacent to each other on a single carrier, attached, for example, by a tape. In this way, the amount of carrier is reduced for supplying the same length of marker sleeves.

While this invention has been described having a carrier for holding the length of sleeves, any means may be employed for holding the length of sleeves in a fixed, straight line. For example, it is within the scope of the present invention to construct the length of sleeves integrally with the means for holding the length of sleeves in a fixed, straight line. Variations and modifications can be made to the present invention without departing from the scope of the present invention, which is limited only by the following claims.

What is claimed is:

1. A marker sleeve assembly comprising:

a carrier having a longitudinal axis, said carrier comprising an inner edge portion and an outer edge portion;

a length of recoverable marker sleeves having an opening therethrough, the opening having a longitudinal axis parallel to the longitudinal axis of the carrier, said length of sleeves comprising a first edge portion and a second edge portion and wherein the first edge portion of the length of sleeves adjoins the inner edge portion of the carrier; and adhesive means for securing the length of sleeves and the carrier along the first edge portion of the length of sleeves and the inner edge portion of the carrier.

2. The marker sleeve assembly as defined in claim 1 wherein the first edge portion of the length of sleeves abuts the carrier.

3. The marker sleeve assembly as defined in claim 1 wherein said carrier comprises multiple layers.

4. The marker sleeve assembly as defined in claim 1 wherein said length of sleeves is separable into individual marker sleeves of varying length.

5. The marker sleeve assembly as defined in claim 1 further comprising lines of perforations in the length of sleeves to facilitate separation of individual markers, said lines of perforations being perpendicular to the longitudinal axis of the length of sleeves.

6. The marker sleeve assembly as defined in claim 1 wherein said length of sleeves has a longitudinal axis and wherein said length of sleeves and carrier are configured so as to be insertable in a printer such that markings are printable on the length of sleeves in a direction parallel to the longitudinal axes of the carrier and the length of sleeves.

7. The marker sleeve assembly as defined in claim 1 wherein said adhesive means comprises a tape.

8. The marker sleeve assembly as defined in claim 7 wherein said tape overlaps said carrier and extends at least partially across said length of sleeves.

9. The marker sleeve assembly as defined in claim 7 wherein said tape overlaps said carrier and extends across the entire width of said length of sleeves.

10. The marker sleeve assembly as defined in claim 1 comprising a second length of sleeves, each length of sleeves having a longitudinal axis parallel to the longitudinal axis of the carrier such that the first length of sleeves adjoins said carrier and the second length of sleeves adjoins the edge portion of said first length of sleeves remote from the carrier.

11. The marker sleeve assembly as defined in claim 1 wherein said carrier comprises a material on which markings are printable and wherein said carrier and said length of sleeves are configured such that markings are printable on both said carrier and said length of sleeves in a single printing operation.

12. The marker sleeve assembly as defined in claim 11 wherein the thickness of the assembly is substantially uniform.

13. The marker sleeve assembly as defined in claim 11 wherein said carrier and said length of sleeves are substantially the same thickness, and are held edge-to-edge by the adhesive means.

14. The marker sleeve assembly as defined in claim 11 wherein said carrier includes a shoulder having a height substantially equal to the thickness of said sleeves and wherein said length of sleeves abuts said shoulder.

15. The marker sleeve assembly as defined in claim 1 wherein said assembly is configured such that markings are printable on both sides of the length of sleeves and carrier.

16. The marker sleeve assembly as defined in claim 1 further comprising holes formed in the carrier adjacent its outer edge portion.

17. A marker sleeve assembly comprising:

a carrier having a longitudinal axis, said carrier comprising an inner edge portion and an outer edge portion;

a length of recoverable marker sleeves having an opening therethrough, the opening having a longitudinal axis parallel to the longitudinal axis of the carrier, said length of sleeves comprising a first edge portion and a second edge portion and wherein the first edge portion of the length of sleeves abuts the carrier;

a tape for securing the length of sleeves and the carrier along the first edge portion of the length of sleeves and the inner edge portion of the carrier, said tape overlapping said carrier and extending at least partially across said length of sleeves;

said length of sleeves comprising perforations in the length of sleeves perpendicular to the longitudinal axis of the opening so as to be separable into individual marker sleeves to form separate individual markers of varying length; and wherein said length of sleeves and carrier are configured so as to be insertable in a printer such that markings are printable on the length of sleeves and on said carrier in a direction parallel to the longitudinal axes of the carrier and the opening.

18. The marker sleeve assembly as defined in claim 17 wherein said carrier includes an outer layer comprising a material on which markings are printable.

* * * * *